US005789648A

United States Patent [19]

Roy et al.

[11] Patent Number: 5,789,648

[45] Date of Patent: Aug. 4, 1998

[54] ARTICLE MADE OUT OF RADIOACTIVE OR HAZARDOUS WASTE AND A METHOD OF MAKING THE SAME

[75] Inventors: Bryan A. Roy, Lenoir City; Joseph D. Ingram, Farragit; Hubert W. Arrowsmith; Timothy B. Ramsey, both of Knoxville, all of Tenn.

[73] Assignee: The Scientific Ecology Group, Inc., Oak Ridge, Tenn.

[21] Appl. No.: 451,449

[22] Filed: May 26, 1995

Related U.S. Application Data

[62] Division of Ser. No. 201,946, Feb. 25, 1994, Pat. No. 5,545,796.

[51] Int. Cl.[6] ..... G21F 9/00

[52] U.S. Cl. ..... 588/1; 252/625; 250/506.1; 376/272

[58] Field of Search ..... 588/1, 201; 75/10.63, 75/10.66, 393, 500, 582; 250/506.1; 376/272; 252/625

[56] References Cited

U.S. PATENT DOCUMENTS

| | | | |
|---|---|---|---|
| 4,167,491 | 9/1979 | Gablin et al. | 252/301.1 |
| 4,451,739 | 5/1984 | Christ et al. | 250/506.1 |
| 4,532,428 | 7/1985 | Dyck et al. | 250/501.1 |
| 4,594,513 | 6/1986 | Suzuki et al. | 250/506.1 |
| 4,767,572 | 8/1988 | Sappok | 252/628 |
| 4,845,372 | 7/1989 | Mallory et al. | 250/506.1 |
| 4,882,092 | 11/1989 | Sappok | 252/628 |
| 4,897,221 | 1/1990 | Manchak, Jr. | 252/633 |
| 4,906,408 | 3/1990 | Bouniol | 252/628 |
| 4,907,641 | 3/1990 | Gaspar | 164/423 |
| 4,930,565 | 6/1990 | Hackman et al. | 164/463 |
| 4,950,426 | 8/1990 | Markowitz et al. | 252/633 |
| 4,995,019 | 2/1991 | Cataloyoud et al. | 376/272 |
| 5,075,045 | 12/1991 | Manchak, Jr. | 252/633 |
| 5,102,615 | 4/1992 | Grando et al. | 376/272 |
| 5,225,114 | 7/1993 | Anderson et al. | 252/633 |
| 5,348,567 | 9/1994 | Chappell | 75/10.66 |
| 5,402,455 | 3/1995 | Angelo, II et al. | 376/272 |

OTHER PUBLICATIONS

W.M. Francioni, "Proposal for the Disposal of Contaminated Steel Parts from Shut Down Nuclear Power Plants", 1982, Atomkernegie–Kerntechnick, Bd. 4, No. 4, pp. 279–280.

Seg Brochure, "Metal Processing" (Feb. 1991).

*Primary Examiner*—Ngoclan Mai

*Attorney, Agent, or Firm*—John R. Lane, Esq.; Edgar H. Haug, Esq.

[57] ABSTRACT

An article, such as a containment system (10), having sides (12) with walls (2) or (24) is made; in one method by using cast, cooled, melted, radioactive metal components where the melted metal has a specific activity over 130 Bq/g; or by providing a contaminated material in the form of a solid, liquid or mixture, and then mixing the contaminated material, to which no more than about 15 weight % of uncontaminated material has been reacted, with a binder, followed by forming the composition into a containment system and then curing it into a mass which contains both contaminated material, and uncontaminated binder acting as a matrix for the contaminated material. This article need not be a containment system but can be a wide variety of objects which are made out of radioactive waste, hazardous waste, and their mixtures.

9 Claims, 3 Drawing Sheets

ARTICLE MADE OUT OF RADIOACTIVE OR HAZARDOUS WASTE AND A METHOD OF MAKING THE SAME

This is a division of application Ser. No. 08/201,946 filed Feb. 25, 1994 U.S. Pat. No. 5,545,796.

FIELD OF THE INVENTION

The present invention relates to an article made from waste materials. The invention also relates to an article for storage, isolation, or other management of "contaminated material", herein defined as radioactive, hazardous, or mixed wastes, and methods of making such an article, where the article itself is made in part from substantial amounts of radioactive, hazardous, or mixed waste materials, such as radioactive metal particulates, radioactive concrete particulates, hazardous waste solids, radioactive liquids, and the like. The term "mixed waste" is herein defined as a combination of radioactive and hazardous waste. The term "hazardous waste" is herein defined as set forth generally in 40 C.F.R. PART 261—"Identification And Listing Of Hazardous Waste", at the time of its use.

BACKGROUND AND SUMMARY OF THE INVENTION

Recycling of materials is often practiced to conserve raw materials. Contaminated materials are often treated to decontaminate their main constituents to allow reuse of these constituents. In general, isolated contaminants or contaminated articles not readily susceptible to decontamination are intended, in accordance with past practice, to be disposed of in ways that put the emphasis on destruction or isolation rather than on considerations of reuse. What therefore has happened and is continuing to happen is that increasing quantities of clean materials are turned into contaminated materials that then have to be disposed of in safe ways.

A wide variety of articles and their uses are discussed herein, one type of which is a container to confine waste.

Before the use of modern storage modules, in many instances nuclear waste and hazardous waste were stored in 55-gallon steel drums. In the case of very low level radioactive waste, such drums are still used, many times being overpacked in plastic containers such as polyethylene, polypropylene and the like. More sophisticated, all steel containment systems, having thick steel walls and an adjustable shielding core, are described in U.S. Pat. No. 4,451,739 (Christ et al.). There, exterior or interior lead or steel wire which serves to attenuate of gamma rays, can be wrapped in as many layers as appropriate to the contaminant waste material's radioactivity.

More recently, outer waste container systems have been made with uncontaminated concrete reinforced with large, uncontaminated metal bars, called "rebar" construction, or a steel reinforcing mesh basket, to improve the strength of the container. However, use of large metal bars and steel mesh generally require thick walled containers. Examples of such containers are shown in U.S. Pat. Nos. 4,950,426 (Markowitz et al.) and 4,845,372 (Mallory et al.). In these containers, filler is used to seal the void space between the outer container and, for example, compacted steel-walled storage drums which alone, contain the radioactive material or hazardous material.

In some instances, various types of fibers are used in place of bars or mesh to reinforce concrete in waste containment vessels. In U.S. Pat. No. 4,995,019 (Cataloyoud et al.), a tight-sealing, drum-covered containment vessel is taught, where cast iron or stainless steel fibers are distributed in a random manner in the concrete container. U.S. Pat. No. 4,167,491 (Gablin et al.) describes disadvantages associated with concrete, the most serious of which is the potential of some radioactive material leaching therefrom. There, water which contains radioactive nickel and cobalt-60 is passed through cation resin exchange beads to concentrate the contaminants, then the wet beads are mixed with an aqueous dispersion of a hydrophilic urea-formaldehyde plastic resin obtaining an acidic curing agent, to form a solid waste block for disposal in a steel or cast iron outer container.

In U.S. Pat. No. 4,594,513 (Suzuki et al.), steel or carbon fibers, or metal gauze, are used to reinforce concrete containers, which containers are then impregnated with a polymerizable monomer, to provide a water impermeable lining. Other ingredients that can be added to concrete multipurpose contaminated waste containers having polymeric liners include amorphous metal fibers, fly ash, and silica fume, as taught in U.S. Pat. No. 5,225,114 (Anderson et al.). There, the container needs no exterior concrete overpack barrier and is also transportable and storable. In other instances, hazardous waste is high-density packed within a solidified radiation shielding by centrifugally casting waste material and polyorganic compounds or cementitious material, to form a monolith having high strength and structural integrity, such as taught in U.S. Pat. No. 5,075,045 (Manchak, Jr.). Radioactive wastes can also be classified, segregated, and cast with a shielding material which encapsulates it and prevents the escape of radiation, as taught in U.S. Pat. No. 4,897,221 (Manchak, Jr.)

In *Atomkernenergie-Kerntechnick*, Bd. 41 (1982), No. 4, pp. 279 to 280, "Proposal for the Disposal of Contaminated Steel Parts from Shut Down Nuclear Power Plants", by W. M. Francioni, shielding materials and disposal of highly radioactive material are discussed. This article describes disposal of waste material by using it to form containers for other waste. It discloses, for example, that, theoretically, any suitable material, such as concrete, iron, or lead can be used for the container. It describes in detail a thick concrete transport container, with an additional, separate, inner shielding liner made of melted, cast, solidified, radioactive steel from reactor tubes, and the like. This article also discusses questions regarding secondary wastes during melting the radioactive steel, and, whether the use of such metal shields would be economical since the metal used, at that time, would have had to be decontaminated to a maximum surface activity of 1 $\mu Ci/cm^2$ (37 Bq/g, or 1 nano Ci/g) for transport from the nuclear facility to a melting facility.

In this same area of using radioactive components in waste transport containers, U.S. Pat. Nos. 4,767,572 (Sappok) and 4,882,092 (Sappok), issued in 1989, teach use of radioactive residues in the formation of radiation shielding structures. They state that one would normally expect that the last thing which could be tolerated in a shielding material is a substance which itself is radioactive. In one embodiment, 25 weights radioactive steel from reactor tubes, and the like, are reacted with 75 weight % of uncontaminated cast iron, and the mixture is melted to provide an alloy filler material. However, here, the amount of radioactive waste is tripled by reactive dilution with uncontaminated material. Other embodiments include use of broken up radioactive concrete as a shielding structure alone or in combination with comminuted, radioactive metal alloys. In all instances, however, to minimize detrimental contribution of radiation to the environment, the radioactive material must have a cobalt-60 equivalent between 1 to 100

Bq/g (0.027 to 2.7 nano Ci/g) before being used to make radiation shielding structures, or transport or storage containers. They state that this lower level is two orders of magnitude higher than natural activity levels which they identify as 0.01 Bq/g. It is also known to melt radioactive metal, such as scrap from nuclear power plants and the like, and recast it to form blocks that are used for shielding, such as is described in SEG Brochure "Metal Processing" Feb. 1991 No. 1165-291.

What is needed is an article which can effectively utilize high level radioactive waste as well as hazardous and mixed waste for a variety of useful purposes. What is also needed is a method of making a containment system where contaminated material, previously defined as radioactive waste, hazardous waste, or mixed waste can be used as part of the containment system itself, at high radioactivity levels and high hazardous waste levels, without expensive chemical decontamination steps, and without any substantial initial dilution by mixing or reaction with substantial amounts of uncontaminated materials, and where the radioactive, hazardous, or mixed elements in the waste can be fixed in the system, so that leaching is not a problem. It is one of the objects of this invention to provide such an article, method, and containment system.

The present invention resides, generally, in the concept that contaminated material, of a wide variety, is suitable for use in making a wider variety of articles than heretofore has been recognized. The present invention also resides, generally, in the concept that it is possible to reduce to a more marked extent than previously recognized, the ratio of clean material used, to contaminated material, in making a large number and variety of articles, including but in no way limited to waste containers. The contaminated materials to which this invention is concerned are primarily radioactive, hazardous, or mixed waste.

Among the many uses for which this invention is applicable, the following are "articles", which serve to illustrate the scope of this invention:

Containers of every conceivable dimension, shape, weight, and capacity for processing temporarily or permanently holding, isolating, disposing, or preserving radioactive or hazardous materials, wastes, waste residues, spent materials, or by-products therefrom; which include radioactive waste or hazardous waste.

Shielding casks, pigs, bells, racks, grids, walls, panels, bricks, blocks, shot, sheet, wool, slabs, etc. that use contaminated lead, polyethylene or other plastics, water, depleted uranium, steels, and other metals, or other radioactive waste or hazardous waste.

Building structures including structural steel or members (beams, columns, posts), panels, t-sections, hollow core slabs, cinder blocks, bollards, curb stops, floors, floors, footer, skin, or modules thereof; which use contaminated concrete, steels, lead or other metals, or plastics or other radioactive waste or hazardous waste.

Linings, insulations, refractories, blankets, coatings that include contaminated materials including materials like contaminated steel fibers, shot, grit, dust and powders. Such linings etc. could be used on rail cars, truck bodies, caissons, open-top waste containers, impoundments, kilns, calciners, secondary combustion chambers, bulk storage facilities, silos, afterburners, quench towers, spray dryers, furnaces, ovens, and other similar thermal or chemical treatment equipment; which use radioactive waste or hazardous waste.

Impact limiters on corners, sides, or surrounding a waste container, made from contaminated polymers, plastics, rubber, organic composites (wood or cellulosic fibers), steel or metal shapes (tubes, grids, cages, etc.); which use at least one of radioactive waste and hazardous waste.

Rollers, breaks, spindles, shears, cutting and shaping tooling for contaminated materials; which use radioactive waste or hazardous waste.

Components for use inside normally contaminated environments including tools, dams, reactor fuel grids, tubes and tube sheets, nozzles, ducts, etc. in nuclear reactors, hot cells, glove boxes, fuel reprocessing facilities, nuclear weapon manufacturing and disassembly facilities, devices holding or containing radioactive sources, etc; which use at least one of radioactive and hazardous waste.

Seals, gaskets, o-rings and the like in applications exposed to radioactive or hazardous wastes and made from contaminated polymer, rubber, plastics, steels, metals, and the like; which use at least one of radioactive waste and hazardous waste.

Dunnage, shoring, bracing, and the like made from contaminated materials to secure radioactive or hazardous materials or wastes; which use at least one of radioactive and hazardous waste.

Water quality systems including settling tanks, ponds, clarifiers, flocculating tanks, sludge beds, grease and grit chambers and the like; which use at least one of radioactive and hazardous waste.

Molds for steel ingots, plastic components, concrete shapes, RIM containers, rubber containers, etc; which use at least one of radioactive and hazardous waste.

Road materials made with or consisting in part or in whole of contaminated materials such as rubber, concrete or stone, steel or other metals for subgrade, bitum course, precast slabs, level course bitum concrete filler and the like; which use at least one of radioactive and hazardous waste.

Conveyers, sluices, tunnels, pipes, galleys, weirs, box culverts, bridges, bridge decks and the like used to convey radioactive or hazardous materials; which use at least one of radioactive and hazardous waste.

Metal shapes of all kinds made for equipment supports, stands, piping, components, teeth, clogs, and other wearing components; which use contaminated steel or other metal.

Process vessels, glove boxes, conveyors, skid plates, rails, wheels, platforms, grids and catwalks; which use contaminated steel or other metal.

Steel wire for reinforcing, welded wire fabric, welded wire cages for holding filters in disposal containers, baghouse bags in place, bows for various tarp-like covers, reinforcing in rubber or polymer parts (conveyor belts, sheets, drop curtains); which use contaminated steel or other metal.

Steel and other metal fibers of all shapes, twists, bends, lengths, thicknesses and aspect ratios to reinforce, add bulk, densify, stiffen, strengthen, toughen or otherwise modify various polymer, rubber, concrete, and refractory materials; where the steel or other fibers are contaminated.

Filters and membranes, and other applications for containing or excluding radioactive or hazardous materials; which use sintered, contaminated steel or other metal.

Boots, gloves, bellows, sleeves, and flexible joints to isolate radioactive or hazardous materials from an environment, or to be used in such an environment such as a hot cell, reactor cavity, glove box, or air lock; which use contaminated polymers or plastics.

Targets for depleted uranium or other projectiles, articles being drop tested, items being crushed, obliterated, or made unrecognizable, such as for classified components, munitions, etc; which use contaminated steel, other metals, concrete or plastics.

Tanks, tank liners, bearings, skid or slip sheets, insulators, impact limiters, bumpers, and balls; which use contaminated polymers or plastics.

Spheres for limiting vaporization from chemical processing tanks; which use contaminated plastic.

Sheeting and bags, used extensively to control contamination in nuclear power facilities; which use contaminated thermoplastics.

Accordingly, in one of many embodiments, the invention relates to an article characterized in consisting essentially of: waste selected from the group consisting of a) radioactive waste, b) hazardous waste, and mixtures thereof. In one of many embodiments, the article can be a contaminated waste article, made solely from cast, cooled, melted, radioactive metal components, where the melted metal used in the article is preferably substantially free of slag residue and has a specific activity over 130 Bq/g, and where the article consists of unsupported cast metal.

We have found, surprisingly, that contaminated metal tubing from, for example nuclear power plants, when melted and separated from slag residue can be used without dilution or alloying with uncontaminated metals, to provide slabs and stand-alone containers for contaminated waste. Even if the contaminated metal has a specific activity level substantially above 100 Bq/g, such as, above 130 Bq/g, it is not detrimental and the metal is still useful. The ability to use materials with high specific activities, such as above 130 Bq/g, minimizes the need for uncontaminated filler or the like in the container or other article. Therefore, other embodiments of the invention are an article, comprising a member, the member consisting essentially of a material selected from the group consisting of a) radioactive waste, b) hazardous waste, and mixtures thereof in a matrix of either concrete binder or plastic resin binder. Also, an article, comprising a member, the member consisting essentially of a material selected from the group consisting of a) radioactive thermoplastic b) hazardous thermoplastic and mixtures thereof; or an article, comprising a member, the member consisting essentially of metal of which more than 35 weight % of the metal is radioactive. Thus, the article could be a member section component or other part structure.

We have discovered that hazardous waste and mixed waste can be used alone to make a wide variety of slab, brick, wall or other type articles. Another aspect of the invention resides in an article characterized as consisting essentially of: waste selected from the group consisting of a) radioactive waste, b) hazardous waste, and mixtures thereof, where, if radioactive waste is in metal form, such metal constitutes more than 35 weight % of the article. This article, during use, can and in most cases will be exposed to radioactive or hazardous waste and therefore become further contaminated. However the article, such as a container is not limited to being exposed to or containing waste. The article could be exposed to or contained various chemicals or other materials not considered contaminated or waste, or could be exposed to or contained "fresh" radioactive or hazardous materials. Use of more than 35 weight % metal will provide integrity for the structure and allow its use as a substantially self-supporting container or the like. Preferably when metal is used it will be substantially free of slag residue.

A preferred high density containment system with a variety of particulate size gradings has also been discovered, and the invention also resides in a containment system for radioactive, hazardous or mixed waste, characterized by having a structure containing a series of different sized particles to provide high interior void volume filling, where at least one fine particulate selected from the group consisting of silica fume and flyash particles and mixtures thereof is close packed between coarse particulate selected from the group consisting of filler, cement and aggregate particles and mixtures thereof, and also containing additives distributed therethrough, selected from the group consisting of uniformly dispersed bars, fibers, generally spherical particles and amorphous particles, and mixtures thereof, such that the containment system has a density over about 90% of theoretical density.

In the above embodiment, the particles and additives can be non-contaminated materials or contaminated materials. The containment system can be thin walled, that is, less than 5 cm thick. It can be a round, square, or other configured storage module, having a bottom, sidewalls and an associated attached lid. The containment system can have a closely attached plastic sheet about 0.2 cm to about 2.5 cm thick, covering at the inside of the system and/or the outside of the system. The contaminated material when used is distributed in the module walls and is not concentrated as a separate inner or outer layer or shield.

The article/structure containment system can be a thick or thin wall type structure of various configurations, for example, primarily plastic containers, radioactive containment shielding; a variety of other rigid or flexible structures, including enclosures, dividers, barriers, burial and storage modules, vaults, trench walls and bunkers.

We have also found very useful containment systems characterized by a structure containing a material selected from concrete or plastic resin, containing within its walls radioactive metal, in the form of discrete fibers constituting from 2 weight % to 55 weight % of the system having lengths from about 0.5 cm to about 20 cm where the system contains different sized particles to provide high interior void volume filling in the case of concrete, or resin impregnated porous metal mesh or discrete fibers in the case of plastic resin.

The invention further resides in a method of making a contaminated waste article characterized by the steps: (A) providing radioactive metal material selected from the group consisting of nickel, chromium, iron, steel, and mixtures and alloys thereof; (B) inspecting said radioactive material to segregate it according to metal type, to provide a metal feed; (C) transporting the radioactive metal feed to a melting furnace operating at a temperature over 1400° C., to melt the radioactive metal feed and form a top impure radioactive slag phase if the feed is impure, and generally a lower level radioactive molten metal phase; (D) casting the radioactive molten metal phase into a radioactive article substantially free of the slag phase; and (E) cooling the cast article to provide a solid radioactive article. These articles could be bricks, wall structures, slabs, containers or the like. They could be transportable and placed in direct or indirect contact with contaminated material. Also the slag phase could be cast into a radioactive article.

The invention also resides in a method of mixing radioactive, hazardous, or mixed waste into a binder matrix to form a containment system for additional, highly concentrated radioactive or hazardous waste characterized by the steps of: (A) providing a contaminated material selected from at least one of: (i) radioactive material in small discrete form, (ii) hazardous waste material in small discrete form; and (iii) mixed waste in small discrete form; (B) mixing thoroughly: (i) about 100 parts by weight of a binder material and (ii) about 2 to about 570 parts by weight of the contaminated material to which no more than about 15 weight % of uncontaminated material has been mixed, to provide a homogeneous composition, in which the contaminated material is in discrete, non-agglomerated form throughout the binder; (C) forming the composition into a unitary, solid containment system which contains contaminated material, and binder acting as a matrix for the contaminated material; and (D) placing the containment system in direct or indirect contact with highly concentrated, radioactive, hazardous, or mixed waste.

The invention very specifically, also resides in a method of making a structure for radioactive, hazardous or mixed waste, utilizing radioactive, hazardous or mixed waste as a component of the structure, characterized by the steps: (A) providing quantities of radioactive material selected from the group consisting of radioactive metal, radioactive concrete, radioactive sand, radioactive gravel, radioactive plastic, radioactive liquid, and mixtures thereof; (B) processing the radioactive material without dilution with any more than about 15 weight % of non-radioactive material, to provide at least one of (i) bars, (ii) fibers, (iii) generally spherical particles, (iv) amorphous particles, (v) sheet plastic, and (vi) stabilized liquids; (C) mixing (i) 100 parts by weight of a binder material and (ii) 0 to about 25 parts by weight of hazardous waste material selected from the group consisting of hazardous solids, hazardous liquids and mixtures thereof, to which is then added (iii) about 2 to about 570 parts by weight of the processed, radioactive material, to provide a homogeneous composition; and (D) forming the composition into a unitary, solid structure. The term "amorphous" as used herein means not having a standard geometrical shape or having an irregular shape.

Most advantageously, the invention resides in a container characterized by having concrete and from 2 weight % to 55 weight % contaminated metal fibers having lengths from 0.5 cm to about 20 cm and a length:width aspect ratio of between 200:1 and 20:1 where the container contains different sized particles to provide high interior void volume filling and a high density, generally over about 90% of theoretical density. The term "high interior void volume filing" as used herein means most voids resulting in a low porosity low void structure.

The initial contaminated material provided can include, radioactive stainless steel tubes used in cooling nuclear reactors, which have been cut into small pieces, or melt cast into small fibers; radioactive concrete chunks and dust resulting from demolition of or around nuclear reactor structures; "plastic" or "plastic resin", which is meant herein to also include rubber sheets or gloves used to deal with hazardous materials, and other materials described later in the specification; ion exchange resins, beads, powders or slurries used in purification processes; powdered hazardous soil; polychlorinated biphenyls; and the like.

The contaminated materials are usually processed by one or more of cutting, grinding, shearing, heating, melting, melt-casting, pressing, and the like, to form small pieces or particulates less than about 50 mm diameter, or squares or fibers less than about 20 cm long. Preferably, only a small portion, of "uncontaminated material", herein defined as virgin, non-contaminated and non-radioactive material is mixed or reacted during processing, so that the volume of contaminated material is not substantially increased prior to mixing with binder. The binder material can be, for example metal, plastic, or a mixture of sand, aggregate and cement, with the possible addition of silica fume, flyash, and plasticizer.

It is essential to thoroughly mix and disperse the contaminated material into its binder, so that the binder forms a matrix containing and firmly binding the discrete pieces or particles of contaminated material. In most cases where the binder is concrete, the cement used will be clean and non-contaminated so that good bonding is achieved, the same is true if a thermoset resin, such as an epoxy resin, is used as the binder. Also, contaminated thermoset resin cannot be remelted and would not provide good bonding.

As distinguished from U.S. Pat. No. 5,402,455 (Angelo et al.) dealing primarily with fiber mesh reinforcement in a concrete container, this invention deals primarily with discrete particles of contaminated material in a wide variety of articles.

In order to uniformly disperse radioactive fibers and particles, when they are used, and prevent clumping/agglomeration and thus concentration of radioactive material, the fibers are preferably processed to within narrow length:width aspect ratios and the particles are preferably processed to within narrow particle sizes and gradation. In the case of concrete binder material, they are preferably combined with chemical plasticizer when incorporated into the binder material. Preferably, a series of different sized contaminated material and binder materials are provided, to allow a close, high density packing and elimination of most void volume in the cured system.

The term "radioactive", as used herein, is defined to mean a level of activity, due to contamination or activation by, for example, radio-isotopes of cobalt, lead, cadmium, cesium, barium, or the like, ranging from 0.1 nano Ci/g to well over 10 nano Ci/g (3.7 Bq/g to well over 370 Bq/g). The contaminated materials used in substantially large volumes in this invention would otherwise have limited usefulness, and only be suitable for direct disposal in the absence of some dramatic technology that could remove the contamination. The containment system can contact or hold loose contaminated material directly, or contaminated material placed in standard or compressed steel drums, plastic containers, or the like, so that there is "indirect" contact of the containment system with the waste through contact with the steel drum or plastic container wall.

The processes of this invention as previously described provide an article, such as a containment system, which has low permeability to water, excellent leach resistance, and, additionally in the case of concrete, high tensile and compressive strength; and which can contain from 2 to 570 parts of radioactive or hazardous material per 100 parts of matrix material, providing a major means for disposal of radioactive or hazardous waste. In the case of a container for contaminated waste, this invention allows an increased payload of contaminated material in the walls of the container of from 10 weight % to 100 weight %, based on contained contaminated material filling the container, usually in the form of compressed drums of contaminated material. Thus, a substantial number of waste containers can be eliminated in transport and burial operations, representing tremendous savings, and minimizing transport operations.

BRIEF DESCRIPTION OF THE DRAWINGS

In order that the invention can be more clearly understood, convenient embodiments thereof will now be described, by way of example, with reference to the accompanying drawings in which.

DESCRIPTION OF THE PREFERRED EMBODIMENTS

Figure 1:
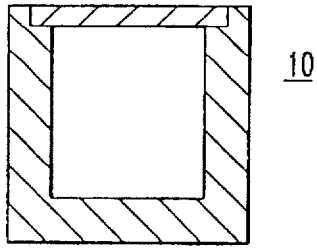
FIG. 1 is a cross-sectional view of an all metal storage module.

Referring now to FIG. 1 of the drawings, one embodiment of a contaminated waste storage container 10, made solely of contaminated metal, is shown. This container has no interior or exterior concrete support or shielding associated with it. The metal for the container is made by melting radioactive rods, tubing, metal nuclear components and the like in a metal melting furnace as described in detail later in this specification. In the furnace, the bottom, lower-grade radioactive melt is separated from a top higher-grade radioactive slag phase. This bottom molten metal is cast into a container form including an associated lid, and cooled. The metal melting process involves expensive, regulated equipment, and so containers made by this process should serve special disposal needs of utilizing radioactive feed metal having at least a 130 Bq/g activity. This container could be used and transported under a variety of circumstances, but would be particularly advantageous where melting, casting the container, filling with contaminated waste material and burial or storage would be in the same site, so that feed metal having as high as or over 370 Bq/g activity can be used, saving tremendous storage or burial volume for very "hot" metal.

Figure 2:
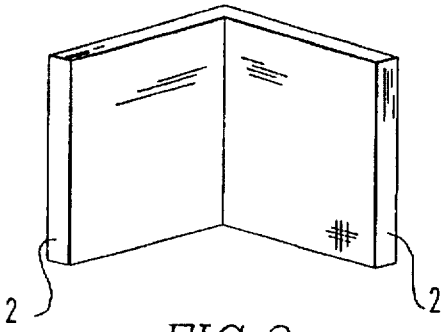
FIG. 2 is a perspective view of a unitary, solid structure or article, such as a wall section, which can be used as radiation containment shielding, made of a composition according to this invention.

FIG. 2 shows one embodiment of a structure or article such as slab wall 2 which can be made of radioactive waste, hazardous waste, or their mixtures. Since this structure may not necessarily be used to directly contain contaminate material, when contaminated metal is used alone in this embodiment, the contaminated metal should not be diluted or alloyed with virgin filler or the like to the point that the contaminated metal constitutes less than 35 weight % of the structure. In this instance, metal slag residue from a metal melter, for example, can be used to make such a slab walls 2, bricks, panels, blocks, sheets, slabs, grids, floors, liners, impact, limiters or the like, as described in detail previously. This structure could also, for example, have a contaminated or non-contaminated, particulate, plastic or rubber matrix containing radioactive concrete, metal, or slag, or a contaminated metal mat matrix filled with plastic.

Figure 3:
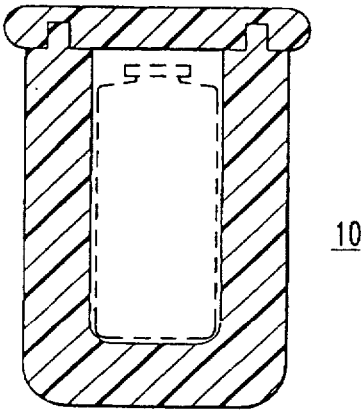
FIG. 3 is a cross-sectional view of a storage module containing plastic material.

FIG. 3 shows another embodiment of the invention, where a storage module 10 is a container having walls and lid substantially or completely of plastic. Useful plastic or plastic resins include, for example, rubber compounds, polypropylene, polycarbonate, polyester, polyvinylidene fluoride, polyvinyl acetate, polyvinyl chloride, epoxy resins, phenolic resins and, preferably, polyethylene which contains a large number of hydrogen atoms per $cm^3$, mixtures and copolymers thereof, and the like, all of which are well known plastics or plastic resins. When the plastic is thermosetting (will degrade rather than melt upon heating) to get good bonding, the plastic should be uncontaminated. This is usually not as important when thermoplastic resins are used since they can be remelted after initial use. Epoxy and phenolic resins are examples of thermosetting resins. When plastic is used as the binder material making up the container walls, hazardous solids in the form of, for example, soil, and "toxic" chemicals such as polychlorinated biphenyls, petroleum hydrocarbons, pentachlorophenols (PCB's, PHC's and PCP's respectively) and the like, can be included. This module can enclose a high integrity container as shown.

While not shown in FIG. 3, the plastic container can contain contaminated metal fibers in discrete form distributed throughout the walls, bottom and lid and/or contaminated metal mesh or contaminated metal mat. The contaminated metal fibers that can be used in discrete form will have the same ranges as those set forth later in this specification for concrete containers. The contaminated metal mesh or mat can be from 60% to 95% porous (5% to 40% of theoretical density). When a metal mesh or mat is used in the plastic container it will provide a metal, open matrix, readily completely impregnated by liquid plastic resinous materials. The wall thickness of the plastic container shown in FIG. 3 can range from 0.5 cm (0.2 inch) to about 7.6 cm (3 inches), and the metal mesh or mat can constitute from 10% to 100% of the final wall thickness, that is, if the plastic container wall is 5 cm thick, the central metal mesh or mat skeleton or matrix can be from 0.5 cm to 5 cm thick. Preferably, however, metal fiber will not penetrate through the exterior wall surface. In processing, the mesh or mat could be placed in a mold and flowable, liquid plastic resin could be injected or poured into the mold to completely impregnate the open, porous mesh or mat; and then the plastic/mesh or that combination can be heated under pressure to cure the plastic resin and cause it to fill all voids, and consolidate the container walls. The plastic can comprise two copolymerizable components or a single plastic resin, all with appropriate diluents, hardeners, flow control agents, catalysts, initiators, and other appropriate additives.

Figure 4:
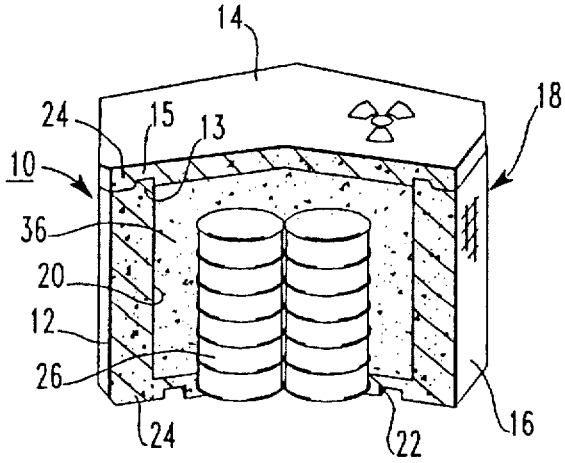
FIG. 4 is a perspective, cutaway view of one embodiment of a unitary storage module packed with drums and made of a cured concrete composition according to this invention.

Referring now to FIG. 4 of the drawings, one embodiment of a unitary structure such as storage module 10 is shown, which includes a container 12 formed of concrete or other suitable material, having a bottom and sidewalls. The container 12 is closed by lid 14 placed atop the upper most edges of the container. The lid 14 is attached to the container by way of ridge 13 on container 12 and a recess 15 on the lid 14.

For the sake of facilitating a stacking relationship of the storage modules 10 in adjacent columns, the storage modules 10 can be shaped as hexagonal prisms, as shown in FIG. 4. Each of the sides of the hexagon is illustrated as a substantially flat side 16, and between each of the sides 16 is corner side 18. When the storage modules 10 are stacked, the sides 16 of adjacent modules 10 abut one another, to define a honeycomb-type arrangement when viewed as a plan view from above. Forklift grooves 22 are shown at the bottom of the module. In all instances, the containers described here and previously can be used as multipurpose containers for processing, transport, storage and/or burial, and can be transported from the manufacturing site of the container to the waste site, loaded with contaminated waste, and transported to a burial site for burial or storage. Also, processing such as solidification, dewatering, and the like, can be carried out in the container before it is sealed.

Within the container 12 in FIG. 4, the sidewalls 16 and 18 define an interior space 20, which is preferably cylindrical. Within the interior space 20, several stacks of steel drums 26 are illustrated. These drums can contain radioactive or hazardous waste in liquid, solid or compressed form. Here, the module walls do not directly contact the waste. In this invention, the container and lid walls 24 also contain processed radioactive, hazardous, or mixed waste material intermixed as discrete fibers, particles, or the like with concrete and other additives. A void space, created in the cylindrical interior space 20 between the waste containers or packages 26 and sides of the container 12, can be filled with a contaminated or non-contaminated granular fill material 36, such as a cementitious grout.

Figure 5:
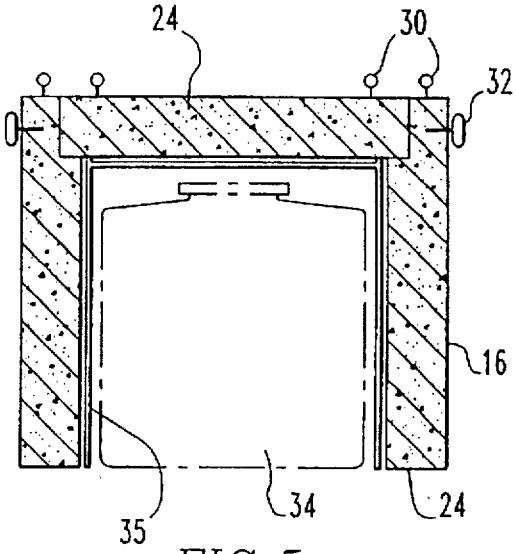
FIG. 5 is a cross-sectional view of a bolted together storage module made of a cured concrete composition according to this invention.

FIG. 5 of the drawings shows one embodiment of a square or round contaminated waste storage container made of concrete or other suitable material having sides 16 and lid 14, with or without a bottom. The sides and top can be set into place by means of lugs 30 and held in place by bolts 32. This module can enclose a high integrity container 34. The container and lid walls 24 in this invention will contain processed radioactive, hazardous or mixed waste material as described previously. A plastic liner is shown as 35.

Figure 6:
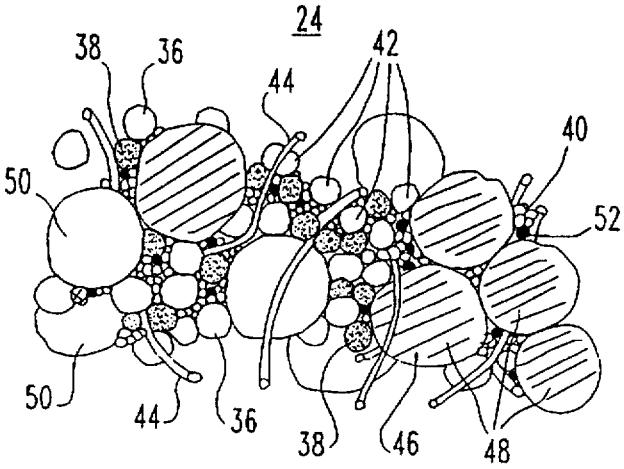
FIG. 6 is an idealized, greatly enlarged, partial cross-section of a small part of a concrete storage module wall made of the cured composition of this invention.

FIG. 6 shows an idealized, enlarged cross-section of an example of the walls 24 of some of the containment systems previously described. As shown, a particulate sand filler 36, shown as medium sized open circles, and cement 38, shown as medium sized shaded circles, form a matrix 42 which would make up most of the body of the wall 24. Interdispersed in the matrix material 24 could be fine flyash particles shown as 40, radioactive metal fibers 44 and/or radioactive, ground, large concrete aggregate or other hazardous material 46 shown as hatched large sized open circles, and virgin, ground, large aggregate shown as large sized open circles 50. While not shown, cut pieces of contaminated plastic material may also be included within the matrix. Unlike the use of fibers or aggregate in a containment structure wall made of totally virgin, uncontaminated materials, it is preferred that the radioactive materials used herein be in a non-agglomerate form and do not clump to create a fiber-aggregate volume 48 of high radioactivity; or at least such agglomerates must be minimized.

The radioactive fibers, radioactive concrete, and hazardous solid waste should be uniformly and homogeneously dispersed throughout the matrix 42 so that they are essentially discrete fibers and particles separated and encapsulated by the matrix material. In the case of a plastic sheet or plastic particulate matrix, without use of metal fibers or metal mat, the contaminated particulates 46 or fibers 44 would be dispersed between encapsulating plastic particulates or connected chains or polymers.

As can be seen in FIG. 6, the largest particles are aggregate particles 46 and 50 and the next largest particles are cement 38 and sand or other filler 36. The cement particles 38 along with the sand or other filler particles 36 form a matrix containing all the other materials. The flyash particles 40, if used, would be the next smallest, and together with the very small, shaded, silica fume particles 52, if used, would provide a series of different sized particles to provide substantially complete interior void volume filling, providing an essentially void free, low porosity article. As described previously, small metal fiber material such as stainless steel can also be used in the structure. Also, spherical and amorphous particles can be used in place of or with the metal fibers 44 shown. It may also be desirable to include uncontaminated carbon, ceramic, plastic or fiberglass fibers as additional reinforcement. In order to accomplish such a radioactive dispersion in the matrix, the radioactive fibers, concrete particles and hazardous waste solids should meet important size and profile parameters and must be added in a certain sequence to the composition mixture.

Figure 7:
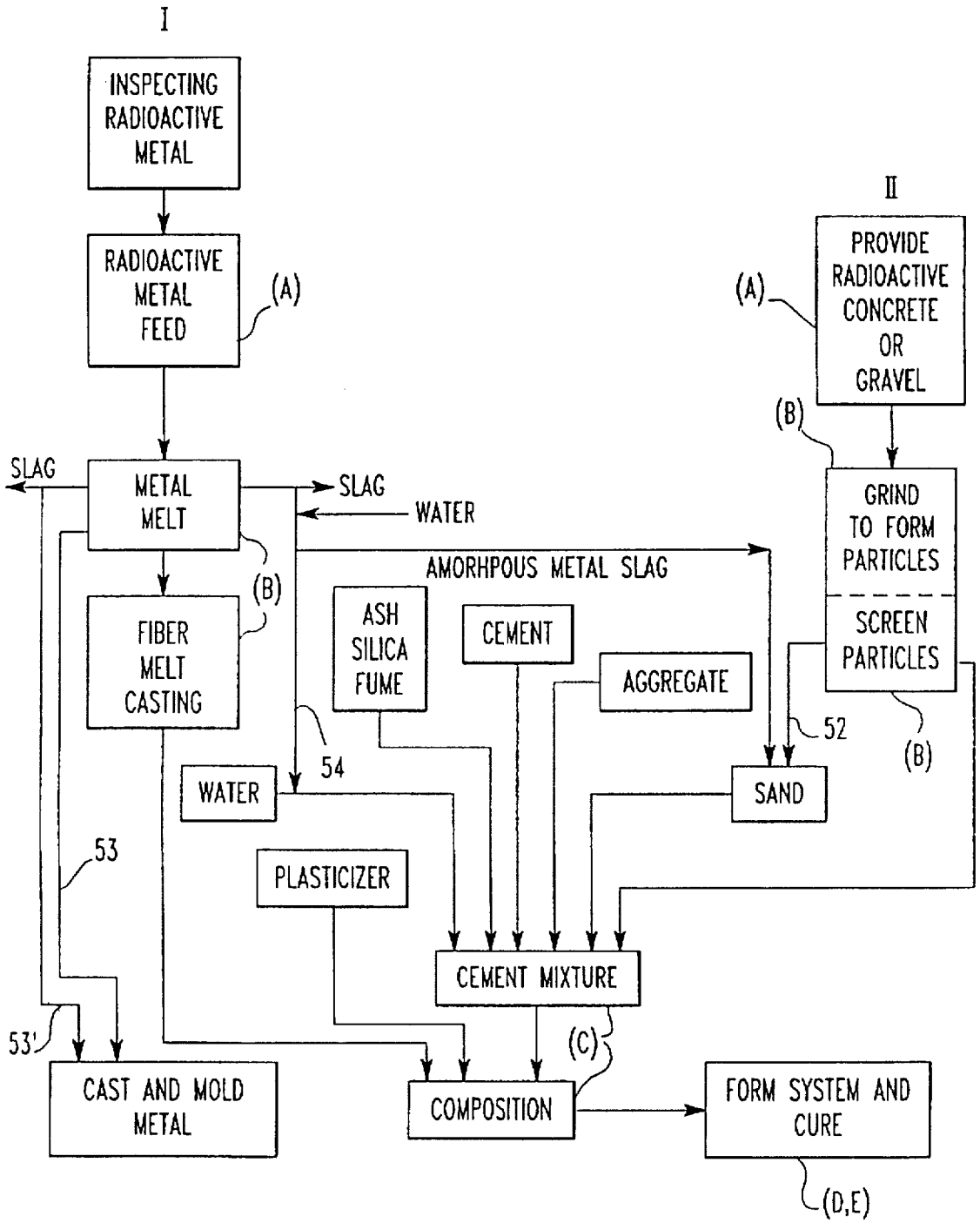
FIG. 7, which best illustrates this invention, is a block diagram describing a variety of embodiments of several of the methods of this invention.

FIG. 7 shows one embodiment of the method of this invention, which will here be described in substantial detail for use of an uncontaminated sand and cement matrix and radioactive metal and radioactive concrete additives, as an example, although the method of this invention is not at all so limited, and the article can include metal alone, metal with hazardous or mixed waste, or a variety of metal or plastic binders such as steel, polyethylene resin, plastic with a metal mat matrix, and the like, as pointed out in detail previously.

FIG. 7 shows two Flow Paths for treatment of radioactive additive. Flow Path I relates to radioactive metal treatment and Flow Path II relates to radioactive concrete treatment. In Flow Path I, radioactive metal, such as stainless steel tubes used in cooling nuclear reactors, piping used on nuclear sites, metal spent fuel channel boxes, centrifuges, compressors and motors used for uranium enrichment, siding used on nuclear reactor site buildings, other stainless steel, nickel, iron, lead, chromium, technetium or other radioactive metal components used in or near nuclear reactors, or the like can be the radioactive starting material. In most cases the metal radioactive starting material will be inspected, and segregated according to metal type, for example, a run of all stainless steel may be made separate from a run of all carbon steel, based on the desired end product to provide a radioactive metal feed (A). All manner of configurations can be used, although in most instances the metal feed will be cut to a convenient size for further treatment, with, for example, shears, acetylene torch, or if necessary an underwater plasma torch, or the like.

The radioactive metal feed will then be transported to a metal melter, such as an induction furnace operating at a temperature over about 1,200° C., which will be described later in the Examples. In the metal melting furnace, a purified, lower grade radioactive, all metal bottom phase is formed, and separated from an impure, higher grade radioactive metal slag top phase. Up to 15 weight % uncontaminated metal as additive, preferably only up to 10 weight % uncontaminated metal, such as nickel, chromium, or the like, may, in some cases, be added and reacted in the furnace where it may be necessary to provide a bottom phase metal composition having special strength characteristics necessary to cast fibers or other articles or structures.

The all metal bottom phase can be used for further processing into metal fibers, or can be cast directly into a variety of articles, such as blocks, slabs,, walls, containers, and the like by means of path 53. Generally, if the slag phase is not separated, any metal fibers produced would not have the physical properties required to provide high tensile strength to the concrete matrix into which they are added, or the metal articles or structures, such as slabs, would not have the required composition for the embodiment needed. However, in rare instances, where very pure radioactive metal feed is used, a top slag phase may not form. Step (B) in FIG. 7 can produce spun metal fibers from the molten metal or cast metal ingots. Such melt spinning of fibers is well known in the art, and further details on such a melt casting process can be found in U.S. Pat. Nos. 4,930,565 (Hackman et al.) and 4,907,641 (Gaspar). While the top phase slag can be poured into molds to make highly radioactive shield block ingots by means of path 53', a portion of the slag could also be quenched by water to form generally spherical particles or agglomerates of amorphous shaped metal which can be used separately as filler via path 54, or added to the sand as shown in FIG. 7.

The size and width or diameter of included metal bars, fibers, generally spherical particles and amorphous particles affects tensile strength and compressive strength of the containment system in which they are used. Radioactive or non-radioactive, cast, reinforcing bars, when used, can have substantial lengths, preferably, of from about 25 cm to about 50 cm and diameters of from about 0.10 cm to about 3 cm. The radioactive metal fibers should have lengths of from about 0.5 cm to about 20 cm, preferably from about 1.0 cm to about 3.5 cm and have a length:width (length to width) aspect ratio of between 200:1 and 20:1, preferably between 150:1 and 75:1. Therefore, if the fiber length is 10 cm, the width or diameter can range from 0.05 cm to 0.5 cm. Fibers of non-conforming geometry are sent back through the metal melt and fiber casting process. The most preferred fibers are stainless steel fibers having a chromium content of from 15% to 26% and a nickel content of from 8% to 14%. When used in concrete the preferred weight % range of the metal fibers is from about 2% to about 55%, most preferably from 2 weight % to 30 weight %. The generally spherical metal particles can have diameters from about 0.001 mm to about 30 mm and the amorphous metal particles can have a thickness of from about 0.01 mm to about 30 mm.

If the fibers are below 0.5 cm in length, they would have no advantageous effect on the tensile strength of the concrete. If the fibers are over 20 cm in length, they will clump and deform, and will not have the desired effect on the tensile strength of the concrete. The metal will be free of any oil residue through the melt casting and prudent handling and storage.

In the Flow Path Row II concrete processing steps, large sections or slabs of radioactive concrete or large size radioactive gravel are provided in step (A). The concrete may be wall sections, chunks, slabs, and dust, resulting from demolition of or around nuclear reactor structures, or it can be used waste containers which have acquired low level radioactivity, and the like. The concrete can be pulverized to provide generally spherical particles having diameters (rough diameters) from about 0.001 mm to about 30 mm in step (B). Road gravel which has become radioactive over the years from vehicles or the like traveling over nuclear site roads using such gravel can also be used, as well as gravel from filtration ponds or the like. This gravel if of large size can also be ground. Its final size should be in the same range as the pulverized concrete. If the particles are below 0.001 mm diameter, it may be detrimental to the strength characteristics of the concrete. If the particles are over 30 mm diameter, it would be difficult to form containers and the like, particularly those having thin walls.

Preferably, the radioactive gravel or concrete particles are not of one size but are distributed substantially equally between 0.001 mm and 30 mm diameter. A variety of particle sizes are required in the embodiment of the method of this invention, the largest being the radioactive concrete aggregate or radioactive road gravel and any virgin aggregate used, the next finest being the filler and virgin sand used with the Portland cement, followed by fine flyash and ultra-fine silica fume, as described later; which all interact to provide high density and low permeability by having small particles within a larger particle matrix and eliminating most void volume. Radioactive concrete dust could be used in association with the uncontaminated sand as shown by path 52 in FIG. 7. Preferably, all the radioactive concrete material will be reduced in size by crushing or grinding to provide a "fresh", wettable surface.

As mentioned previously, uncontaminated river "pea" gravel or man-made virgin aggregate can be used in addition to the radioactive concrete particles. The uncontaminated aggregate will have the same rough diameter particle size range of about 0.001 mm to 30 cm as the radioactive concrete particles. Based on the amount of radioactive concrete particles to be used, the amount of virgin gravel can be determined so as to provide a useful, dry concrete mix, approximating weight ratios of (aggregate):(sand):(cement):(water) of (10):(5 to 7):(3 to 4):(1 to 2).

The particle size of the sand, which can be river sand or finely ground rock or aggregate and which acts as filler should be in the rough diameter particle size range of from about 0.015 mm to about 10 mm, a range below the aggregate size. Amorphous radioactive metal slag particles resulting from water quenching of slag, as shown in FIG. 6 can be used as filler in substitution for part of the sand as long as it is round if needed to fit into the sand particle size range, that is, a thickness of from about 0.015 mm to about 10 mm.

As previously mentioned, any very fine radioactive concrete dust in the sand particle size range can be added with the sand in making the initial cement mixture, but its weight amount will be determined by the limits on weight % radioactive concrete allowed to be added. Portland cement will be used in an amount determined by the above (aggregate):(sand):(cement):(water) ratio. The Portland cement is uncontaminated and is preferably a low heat of hydration cement, that produces a minimum of heat during cure, and consistency cement mixture. Subsequent addition of plasticizer will increase the slump level and flowability or plasticity of the concrete. Radioactive water, such as that resulting from quenching slag as shown in FIG. 7 can be fed by path 56 to replace some or all of the water used in the concrete mixture.

Other components that are added to the concrete mixture, as shown in FIG. 6, are flyash 40 and silica fume 50. Flyash is the very fine ash produced by combustion of powdered coal with forced draft, and often carried off with the fuel gases from such processes. A baghouse filter or electrostatic precipitator is necessary for effective recovery. Considerable percentages of CaO, MgO, silica and alumina are present in the flyash. The particle size of the flyash is preferably from about 0.001 mm to about 0.01 mm. This provides particles finer than sand and larger particles than silica fume.

Silica fume, or fumed silica, is a colloidal form of silica, $SiO_2$, made by combustion of silicon tetrachloride in hydrogen-oxygen furnaces. It is a fine white powder, and for the purposes of this invention will have a particle size range from about 0.00015 mm to about 0.0015 mm, providing ultra-fine particles which are extremely important in adding strength and increasing the density of the cured containment system, so that it has a low permeability eliminating leakage possibilities. The preferred range of these components is about 0.2 to about 2 parts by weight of silica fume, and about 0.5 to about 4 parts by weight of flyash, based on 100 parts of binder material, where from about 0.1 to about 1 part by weight of chemical plasticizer, based on 100 parts of binder material is added with the processed, radioactive material, based on mix workability requirements.

Other additives can also be used, for example air entrainer materials, which, when added in a small effective amount, causes microscopic air bubbles in the cured containment system upon cure. These microscopic air bubbles provide an insulative effect and increase freeze/thaw resistance to cracking. Another useful additive is a hardener which also allows reduction of water content and improves workability and finish.

Although virtually any circumstance is possible, clean, uncontaminated cement will be used when it is a binder; and thermoplastic resins, such as epoxy resins will always be clean and uncontaminated when used as a binder, as mentioned previously, to insure good bonding.

After the concrete mixture is thoroughly mixed and at a consistency of about a 3 to 7 cm slump, the plasticizer and radioactive metal, are slowly added, preferably, over a 10 minute to 20 minute period, at a stir-mixing rate, preferably, of approximately 30 rpm to 50 rpm, for batches of 900 to 2,700 kg.

The resulting form of the cast composition can be any of those shown in the drawings, for example, the container structure of FIGS. 4 and 5, or the wall or barrier structure of FIG. 2, and the like. These structures can have a liner coating, or layer, 35, as shown, for example in FIG. 5, on the inside or outside, such as a plastic resin, water barrier coating, metallized coatings, and the like, to serve a variety of purposes including preventing stirred liquids from leaking out or exterior water or liquids from leaking in. Plastic or plastic resins, described previously, for example polyethylene, polyvinylidene fluoride, polypropylene and polyvinylchloride, are particularly advantageous for inner and/or outer plate or sheet coverings of the exterior of the container or as closely conforming interior liners, having thicknesses of from about 0.2 cm to about 2.5 cm. These liners and exterior covers can add substantially to fracture resistant properties as well as containment and leak proof properties. These plastic resin liners and exterior covers can be conveniently used in concrete fabrication of containers as inner and outer forms for the concrete.

These liners and exterior covers, preferably, are closely attached to the concrete, most preferably by means of anchor means, integral to the liner or cover, which are embedded in the concrete. For example, liner or cover ribs, dovetails or T portions and the like, extending from the liner or cover into the concrete to anchor, connect and interlock the plastic resin and the concrete upon the concrete setting are advantageous, as described in U.S. Ser. No. 07/758,220, filed on Sep. 12, 1991 by the assignee of this invention, entitled "Storage Module For Nuclear Waste With Improved Liner" (Meess W. E. 55,126-C2). The liner or cover can also be simply molded or injected to close fit, and possibly impregnate the surface of the concrete, creating a bond with the concrete container, or can be glued in place by a suitable, high strength, water resistant adhesive.

In the case of making a plastic container such as shown in FIG. 3, the following general steps would be taken. First, contaminated plastic drums, bags or the like are cut to an appropriate size so that they can be melted to form a fluid, pourable mass. Then the hazardous fluid mass would be, generally, centrifugally cast, as is well known in the art. This casting can be used in conjunction with the metal fibers or metal mesh or metal mat as previously described.

The following examples further illustrate the invention, and should not be considered limiting in any way.

EXAMPLE 1

Contaminated waste structures, in the form of blocks, were made utilizing a licensed, pilot, metal melter induction furnace from cooled, cast, melted, radioactive metal tubing waste. The all-metal blocks had a specific activity over about 130 Bq/g and had no support. The blocks were substantially free of slag residue. Blocks of this type would be useful for shielding material. A transportable, multipurpose container similar to that shown in FIG. 1 could also easily be cast from such radioactive metal tubing waste.

EXAMPLE 2

Figure 8:
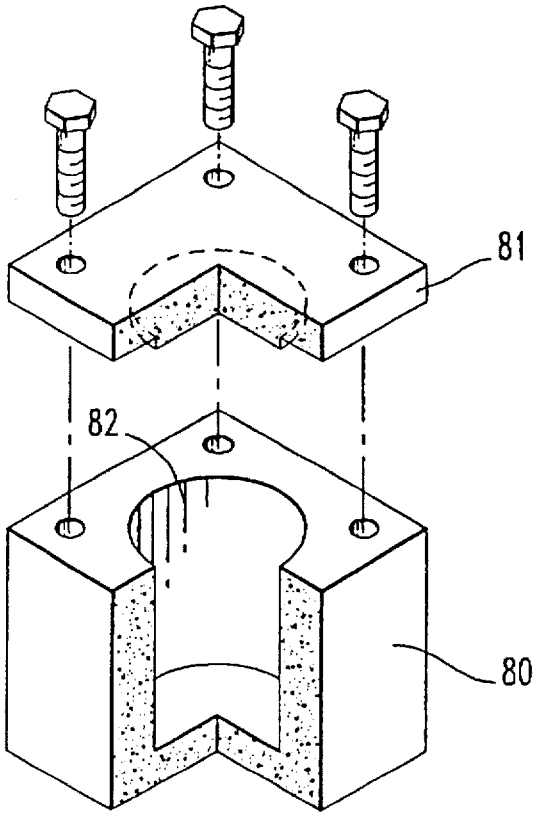
FIG. 8, which is a perspective, cutaway view of the containment system fabricated in Example 2.

Two small box forms were made to provide cast concrete containers having outside dimensions of 406 mm wide×406 mm long×355 mm high, with an internal right circular cylinder cavity measuring 300 mm in diameter by 300 mm high. The forms were coated with an organic release material to aid in stripping once the concrete was poured. The forms were also coated with sealant at the joints to prevent concrete bleed. These forms were then filled with a radioactive concrete mixture, resulting in containers with 50 mm thick walls and bottom to which a separate lid was formed having a minimum thickness of 50 mm and outside dimensions of 40.6 cm×40.6 cm to match the container which was 40.6 cm×40.6 cm. The completed modules provided stackable modules providing a minimum of 50 mm of concrete between the internal cavity and the environment. The container is the same as shown in FIG. 8 as 80, with top 81 and cavity 82 for waste material. While this container sacrificed packaging efficiency with thickening of walls at the diagonal corners, its fabrication was considered acceptable for a prototype. The concrete mix for both containers contained highly radioactive metal slag agglomerates, contaminated fibers, contaminated concrete aggregate and contaminated water, where both samples also contained uncontaminated aggregate, sand, cement, and flyash.

Radioactive slag was obtained from the Westinghouse Electric Corporation, Scientific Ecology Group (SEG), metal melt facility at Oak Ridge, Tenn. The slag material was analyzed at the SEG laboratory facilities using a Tennelec Model CPVDS30-29195 for a SOLO CUP Analysis. The highest levels of activity were found to be from Cesium 137, Cobalt 60, and Uranium 235 and 238, and the total activity was found to be 7750.8870 disintegrations per minute per gram (dpm/g). A substantial amount of this was to be used in the container.

Contaminated clean-up water resulting from daily SEG cask maintenance and cleaning operations was obtained for use as the concrete mix water and contaminating liquid. The water used was analyzed at the SEG laboratory facilities. The analysis of the clean-up water shows an actively level resulting primarily from one radionuclide, Cobalt 60, and the total activity was found to be 0.222 dpm/g.

Crushed recycled concrete was obtained for this project by demolishing a portion of the lid of an earlier manufactured concrete container. The concrete was crushed by hand into pellet sizes no larger than 19 mm in diameter. The recycled concrete was washed in the above described contaminated water for fine partial removal and therefore is deemed to have the same radiological properties, resulting primarily from Cobalt 60.

Stainless steel reinforcing fibers were obtained. These fibers are commercially available under the trade name MelTEC Stainless Steel Fibers. The stainless steel fibers were rinsed in the above described contaminated water to aid in the adherence of the stainless steel fibers to the cement. Due to the use of contaminated water the stainless steel fibers are considered to have the same radiological characteristics, resulting primarily from Cobalt 60. The fibers were all approximately 15 mm to 16 mm in length. While the water, crushed concrete and steel fibers were not strictly radioactive as defined previously, they did have activity levels above natural activity levels and were certainly tainted with radioactive elements and were contaminated.

Clean limestone based aggregate material conforming to AASHTO number 67 stone gradation and properties was obtained. Clean river sand conforming to AASHTO requirements for concrete sand was also obtained. This sand material as well as the clean limestone based aggregate are generally the same as that used in making normal precast concrete. Type 1 Portland Cement was obtained. The cement was as commercially available for sale for all construction activities. Standard concrete quality fly ash was also obtained from the SEG solidification operations.

A summary of the materials used in both containers is shown below in Table 1:

TABLE 1

| MATERIAL | PARTS BY WT | WT % | PARTICLE SIZE (mm) |
|---|---|---|---|
| Cement | 60 | 14.8 | 0.0015–0.01 |
| Sand | 110 | 27.1 | 0.1–1.0 |
| Aggregate | 140 | 34.6 | 0.1–10 |
| Contaminated Stainless Fibers | 15 | 2.7 | 15.87 |
| Contaminated Fractured Concrete | 25 | 6.2 | 0.1–20 |
| Radioactive Slag | 25 | 6.2 | 1–30 |
| Contaminated Water | 30 | 7.4 | |

Prior to any mixing or handling of materials, all workers were dressed in protective clothing and had passed the SEG Radiation Workers Safety Course. In addition to written instructions oral directions were also given for the mixing of the concrete batch.

The composition steps were as follows, where all components were added by weight measurements in the following order with complete mixing:

1) Aggregate
2) Radioactive Slag
3) Contaminated Fractured Concrete
4) Sand
5) Cement
6) Contaminated Water
7) Contaminated 15.87 mm (⅝ inch) Stainless Steel Fibers
8) Plasticizers (0.2 wt. %)

The mixing procedure was to first add the aggregate (including slag and recycled concrete), sand, cement and water, mixing thoroughly as the ingredients were added. The water was added at a rate to maintain an approximate four inch slump according to ASTM standards. Once the concrete mix was completed, the steel fibers were added slowly to the mix ensuring even distribution. Care was taken to add water to maintain a workable slump of at least 4 inches. With the concrete thoroughly mixed and all ingredients added in proper proportions the concrete was ready for pouring.

The concrete was thoroughly mixed, ensuring even distribution of all materials including radioactive constituents. The concrete was introduced to the forms by hand and rolled into its final position. The two containers were cured for 2 days in the forms under plastic sheeting.

The freshly poured containers were sprayed with a service water mist and wrapped in plastic and allowed to mist cure according to ASTM standard specifications for three days. After three days of curing the containers were unwrapped and the wood and plastic forms removed. All residual material resulting from the forming process was cleaned from the containers using hand tools. The completed containers were inspected and then sprayed with a water mist, repackaged and allowed to cure for the remaining 25 days to reach full design strength. Following the 28 day curing period the containers were removed from their wrapping and cosmetic repairs for surface blemishes and minor honeycombing, caused by form bleed, were completed. The tops were fitted to the containers and they were then surveyed by SEG Health Physics personnel for radiological activity.

The results of all the testings on the containers is shown in Table 2 below:

TABLE 2

| Sample Containers 1 and 2 | Radioactivity Levels |
|---|---|
| Water | $3.76 \times 10^{-7}$ μCi/ml* = 0.222 dpm/g |
| Fibers | $3.76 \times 10^{-7}$ μCi/ml* = 0.222 dpm/g |
| Fractured Concrete | $3.76 \times 10^{-7}$ μCi/ml* = 0.222 dpm/g |
| Slag | $7.75 \times 10^{3}$ dpm/gr** = $2.5 \times 10^{-3}$ μCi/ml |

*0.0139 Bq/g
**129.5 Bq/g

The use of 6.2 wt. % highly radioactive slag provided substantial radioactive material content in the containers. Final density of the concrete containers was over 90% of theoretical.

Similar results would be achieved with commercial sized containers, for example, containers having internal dimensions of 182 cm length×122 cm width and 122 cm height, with a lid weighing 318 kg and a container weight of 1,730 kg; able to contain up to about 1375 kg of contaminated material within the container structure itself and an internal payload of about 2,270 kg of contaminated material. Thus, utilization of this invention could increase total contaminated payload by about 60% compared to a container made of uncontaminated material.

The two sample concrete containers were then delivered for use as waste process, transport, storage and disposal containers at the SEG facility. The small size and uniqueness of the prototypes limited the uses of the containers.

Sample container 1 was lined with a polypropelene liner similar to material commercially available for material transport buckets. The exterior surfaces of container 1 were coated with a commercially available concrete penetrant and sealer. With the liner tightly in place and the coating dried, radiological waste material from the SEG facility was placed in the container. The lid of the container was sealed and the outside of the container was surveyed for surface activity. A level of activity below that of background was found and recorded. The container was then transported for temporary storage at the SEG facility.

Sample container 2 was not lined or coated as was Sample container 1. Instead, Sample container 2 had a standard, radioactive waste container placed inside the body of the sample container. The standard container held waste material deposited and processed to SEG standards. The material in the sample container was then wrapped, sealed and the lid placed on the sample container. The entire sample container was then surveyed for surface activity and was found to be below 0.5 milirem. This sealed sample container was then permanently sealed, packaged and legally transported by SEG from Oak Ridge, Tenn. to a waste disposal site in Barnwell, S.C.

As can be seen contaminated materials can be used, or reused, in a wide variety of articles, many of which are, or can be, applied to purposes in which they are again, or further, contaminated.

We claim:

1. An article consisting essentially of: waste, the waste consisting of a) radioactive waste, and b) hazardous waste, where, the radioactive waste is in metal form, and such metal constitutes more than 35 weight % of the article.

2. The article of claim 1 which, during use, is exposed to radioactive or hazardous waste and therefore may become further contaminated.

3. The article of claim 1, in the form of a contaminated waste article, made solely from cast, cooled, melted, radioactive metal components, where the melted metal used in the article is substantially free of slag residue and has a specific activity over 30 Bq/g.

4. The article of claim 1, in the form of a transportable container.

5. The article of claim 3, in the form of a transportable container.

6. An article, comprising a member, the member consisting essentially of metal of which more than 35 weight % of the metal is radioactive.

7. The article of claim 6, where the article is transportable and the radioactive metal is selected from the group consisting of nickel, chromium, iron, steel, and mixtures and alloys thereof.

8. A container, comprising a member, the member consisting essentially of metal of which more than 35 weight % of the metal is radioactive.

9. The container of claim 8, where the container is transportable and the radioactive metal is selected from the group consisting of nickel, chromium, iron, steel, and mixtures and alloys thereof.

* * * * *